United States Patent [19]

von dem Hagen

[11] 4,066,313

[45] Jan. 3, 1978

[54] SAFETY GUARD FOR ELECTRICAL PLUGS

[76] Inventor: Tronje von dem Hagen, 64 Doherty Drive, Clifton, N.J. 07013

[21] Appl. No.: 711,240

[22] Filed: Aug. 3, 1976

[51] Int. Cl.[2] ..... H01R 13/54

[52] U.S. Cl. ..... 339/75 P; 339/91 R

[58] Field of Search ..... 339/39, 75 P, 91 R

[56] References Cited

U.S. PATENT DOCUMENTS

| | | | |
|---|---|---|---|
| 3,067,402 | 12/1962 | Thaw | 339/39 X |
| 3,775,729 | 11/1973 | Casper | 339/75 P |

OTHER PUBLICATIONS

Popular Mechanics, Nov. 1959, p. 164.

*Primary Examiner*—Joseph H. McGlynn
*Assistant Examiner*—E. F. Desmond
*Attorney, Agent, or Firm*—Allen D. Brufsky

[57] ABSTRACT

A safety guard for electrical plugs or multiple plug adaptors including a hollow support element adapted to be affixed to the face plate of an electrical receptacle outlet, a substantially "L" shaped support bracket adapted to slideably cooperate with the support element and engage a cord of a plug inserted in the receptacle outlet, means for removably securing the cord to the support bracket, and means for adjustably securing the support bracket within the hollow support element.

7 Claims, 1 Drawing Figure

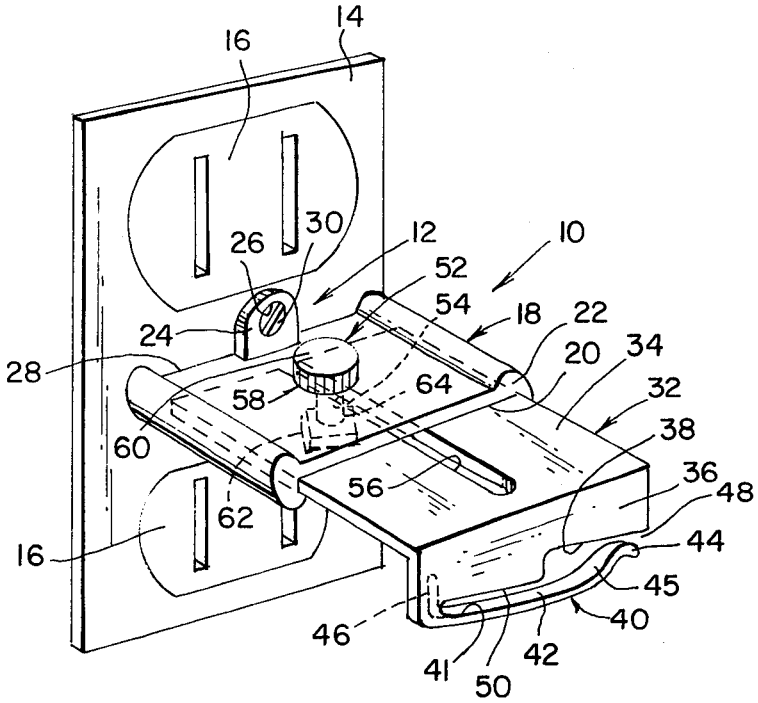
14
16
30
26
12
10
52
54
18
22
24
20
34
28
64
58
32
38
60
36
56
48
62
44
16
45
40
46
42
41
50

SAFETY GUARD FOR ELECTRICAL PLUGS

BACKGROUND OF THE INVENTION

1. Field of the Invention

The present invention relates to safety devices for electrical receptacle outlets, and more particularly, to a safety guard for securing electrical plugs or multiple plug adaptors commonly known as "cube taps" inserted in receptacle outlets.

2. Description of the Prior Art

The prior art includes several devices which are adapted to secure an electrical plug inserted in a receptacle outlet. Some of these devices do not provide means for adjusting to different size plugs or multiple plug adaptors and others do not provide means for the retention of plugs when the cord affixed thereto is pulled in certain directions.

In the U.S. Pat. No. 2,659,059 to Johnson issued Nov. 10, 1953 a retainer for electrical attachment plugs is disclosed which includes a support member adapted to be secured to a wall plate and a retaining member adapted to slideably cooperate with the support member and having bifurcated jaws adapted to retain an electrical cord therebetween. The cord may slip from the jaws if pulled sharply downward.

Further included in the prior art is the U.S. Pat. No. 3,811,104 to Caldwell issued May 14, 1974 disclosing a safety device for electrical outlets which includes a "U" shaped element adapted to retain a cord therebetween, the element being affixed to a bracket secured to a wall plate. The bracket is fixed in length.

The present invention overcomes the problems in the prior art by providing an adjustable safety guard for electrical plugs or multiple plug adaptors which includes means for removably securing a cord affixed to an electrical plug within an electrical receptacle.

SUMMARY OF THE INVENTION

Therefore, it is a primary object of the present invention to provide a safety guard for electrical plugs which may be adjusted to retain different size plugs and multiple outlet adaptors.

A further object of the present invention is to provide means for removably securing a cord affixed to an electrical plug inserted in a receptacle outlet.

A still further object is to provide a safety guard for electrical plugs which may be used to secure more than one plug simultaneously.

Still another object is to provide a safety guard for electrical plugs which may be used with multiple plug adaptors or the like.

Another object is to provide a safety guard which is simple in design and inexpensive to manufacture.

These objects, as well as further objects and advantages, of the present invention will become readily apparent after reading the description of a non-limiting illustrative embodiment and the accompanying drawings.

A safety guard for electrical plugs according to the principles of the present invention includes a substantially hollow support element adapted to be affixed by affixing means to the face plate of a receptacle outlet, the hollow support element having a substantially horizontal longitudinal opening in an edge thereof furthermost from the face plate; a substantially "L" shaped support bracket adapted to slideably cooperate on a first portion thereof with the hollow support element through the longitudinal opening, a second portion of the "L" shaped bracket adapted to engage within a slit therein a cord affixed to a plug inserted in the receptacle outlet; means for removably securing the cord within the slit; and means for adjustably securing the support bracket within the hollow support element.

BRIEF DESCRIPTION OF THE DRAWING

In order that the present invention may be fully understood, it will now be described, by way of example, with reference to the accompanying drawing in which:

The sole FIGURE illustrates a pictorial representation of the preferred embodiment of the present invention constructed according to the principles of the present invention.

DESCRIPTION OF THE PREFERRED EMBODIMENT

Referring now to the sole FIGURE, there is illustrated therein the preferred embodiment of the present invention, a safety guard for electrical plugs 10 affixed by affixing means 12 to a face plate 14 secured to a receptacle outlet 16. The safety guard 10 includes a substantially horizontal hollow support element 18 preferably rectangular in shape having a substantially horizontal longitudinal opening 20 in an edge 22 thereof furthermost from the face plate 14. The longitudinal axis of the opening 20 is preferably substantially normal to the face plate 14. The affixing means 12 preferably includes a tab element 24 having a hole 26 therethrough affixed to the edge 28 of the support element 18 adjacent to the face plate 14. The hole 26 is adapted to engage and be secured by a screw 30 provided for holding the face plate 14 against the receptacle outlet 16.

A substantially "L" shaped support bracket 32 constructed of non-conductive material such as plastic, is adapted to cooperate on a first portion 34 thereof with the hollow support element 18 through the longitudinal opening 20. A second portion 36 of the support bracket 32 is adapted to engage within a slit 38 therein a cord affixed to a plug not shown inserted in the outlet 16. The second portion 36 is slid against the plug and secures the same in place.

The cord is removably secured by movable securing means 40 within the slot 38. The securing means 40 may be configured as a springy means 42 attached to portion 36 and separated therefrom by slit 41 which may be extended for added springiness by slit 46. Springy member 42 is shown bent 45 towards portion 36 at its open end with tip 44 bent away providing entrance 48 for insertion of the cord. An alternate securing means may be provided configured as a clip-like device adapted to circumscribe the cord and to be secured therearound. The edges 50 of the slit 38 are preferably padded with a protective material not shown to remove possible strain on the cord if pulled.

Means for adjustably securing the support bracket 32 within the hollow support element 18 preferably includes a bolt means 52 inserted through a vertically disposed aperture 54 in the support element 18 and an elongated aperture 56 disposed in the first portion 34 of the support bracket 32 adapted to slideably cooperate with the hollow support element 18. The ends of the elongated aperture 56 define a line substantially normal to the face plate 14. The elongated aperture 56 is adapted to slideably cooperate with the bolt means 52. When tightened, the bolt means 52 is adapted to secure the support bracket 32 in a desired position against the plug. The bolt means 52 preferably comprises a bolt 58 having a knurled head portion 60 adapted to be turned by a human hand and a nut element 62 adapted to be threadably secure to the shank portion 64 of the bolt 58.

In an alternate embodiment the support bracket 32 may further include a third portion not shown affixed thereto perpendicular to the first portion 34 forming a substantially "T" shape. The third portion is adapted to engage within a slit therein a second cord affixed to a second plug inserted into the receptacle outlet 16. The third portion preferably includes second means for securing the second cord within the second slit.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A safety guard for electrical plugs and multiple plug adaptors inserted in receptacles, comprising:

a. a support element adapted to be affixed by affixing means to the face plate of a receptacle outlet, said support element being substantially transverse to said receptacle face plate and having a substantially longitudinal opening in an edge thereof further most from said face plate;

b. a substantially "L" shaped support bracket adapted to slideably cooperate on a first portion thereof with said support element through said longitudinal opening, a second portion of said "L" shaped support bracket defining a slot therein and adapted to engage within the slot a cord affixed to a plug inserted in said receptacle outlet, said "L" shaped support bracked retaining said plug within said receptacle;

c. means for removably securing said cord within said slot; said removable securing means comprising a spring urged member affixed to said second portion and adapted to close the open end of said slot and secure the cord, and d. means for adjustably securing said support bracket to said support element.

2. The safety guard as claimed in claim 1, wherein said affixing means comprises a tab element having a hole therethrough affixed to the edge of said support element adjacent to said face plate, said hole adapted to engage and be secured by a screw holding said face plate against said receptacle outlet.

3. The safety guard as claimed in claim 1, wherein said support element is substantially rectangular in shape.

4. The safety guard as claimed in claim 1, wherein said edge including said longitudinal opening is substantially parallel to said face plate.

5. The safety guard as claimed in claim 1, wherein said adjustable securing means comprises a bolt means inserted through an aperture disposed in said support element and an elongated aperture disposed in said portion of said support bracket adapted to slideably cooperate with said hollow support element, the ends of said elongated aperture defining a line substantially normal to said face plate, said elongated aperture adapted to slideably cooperate with said bolt means, said bolt means when tightened adapted to secure said support bracket in a desired position.

6. The safety guard as claimed in claim 1, wherein said bolt means comprises a bolt having a knurled head portion adapted to be turned by a human hand, and a nut element adapted to be threadably secured to the shank portion of said bolt.

7. The safety guard as claimed in claim 1, wherein the edges of said slot are padded with a protective material.

* * * * *